US008961237B2

(12) United States Patent
Xu et al.

(10) Patent No.: US 8,961,237 B2
(45) Date of Patent: Feb. 24, 2015

(54) CONNECTOR ASSEMBLY HAVING POWER CONTACTS WHICH COMPRISE A PLURALITY OF CONTACT INSERTING PORTIONS

(71) Applicant: Advanced-Connectek Inc., Taipei (TW)

(72) Inventors: Fu-Yi Xu, Taipei (TW); Wei Wan, Taipei (TW); Shu-Lin Duan, Taipei (TW); Ju-Chu Hsieh, Taipei (TW); Hung-Ming Chen, Taipei (TW); Hisato Takase, Taipei (TW)

(73) Assignee: Advanced-Connectek Inc., Taipei (TW)

( * ) Notice: Subject to any disclaimer, the term of this patent is extended or adjusted under 35 U.S.C. 154(b) by 54 days.

(21) Appl. No.: 14/018,859

(22) Filed: Sep. 5, 2013

(65) Prior Publication Data

US 2014/0065869 A1 Mar. 6, 2014

(30) Foreign Application Priority Data

Sep. 6, 2012 (CN) ..... 2012 1 0326696

(51) Int. Cl.

| | |
|---|---|
| ***H01R 24/00*** | (2011.01) |
| ***H01R 13/629*** | (2006.01) |
| ***H01R 13/641*** | (2006.01) |
| ***H01R 13/6583*** | (2011.01) |

(52) U.S. Cl.

CPC ..... *H01R 13/629* (2013.01); *H01R 13/641* (2013.01); *H01R 13/6583* (2013.01)

USPC ..... 439/660

(58) Field of Classification Search

USPC ..... 439/345, 607.01, 660, 676, 862
IPC ..... H01R 13/2492,13/2457, 13/2464
See application file for complete search history.

(56) References Cited

U.S. PATENT DOCUMENTS

| | | | | |
|---|---|---|---|---|
| 7,824,227 | B1 * | 11/2010 | Lee et al. | 439/660 |
| 8,033,869 | B1 * | 10/2011 | Zhu et al. | 439/660 |
| 8,133,079 | B2 * | 3/2012 | He | 439/660 |
| 8,721,353 | B2 * | 5/2014 | Xu et al. | 439/108 |

* cited by examiner

*Primary Examiner* — Vanessa Girardi
(74) *Attorney, Agent, or Firm* — Rabin & Berdo, P.C.

(57) ABSTRACT

A connector assembly has a plug and socket; the plug includes an insulative body, at least one first power contact, at least one second power contact and a metal shield. The insulative body has a base portion and a tongue portion extending from the base portion. The tongue portion includes a plurality of power contact grooves and penetrates through the base portion, and at least one first convex portion defined in a periphery of the tongue portion. The first power contact and the second power contact are respectively formed on the power contact grooves of the insulative body for connection to a power source in a socket of host device. The metal shield encloses the tongue portion of the insulative body to cover the tongue portion. Consequently, the charging speed can be increased, reducing charging time.

10 Claims, 9 Drawing Sheets

CONNECTOR ASSEMBLY HAVING POWER CONTACTS WHICH COMPRISE A PLURALITY OF CONTACT INSERTING PORTIONS

CROSS-REFERENCE TO RELATED APPLICATION

This non-provisional application claims priority under 35 U.S.C. §119(a) on Patent Application No. 201210326696.8 filed in China, P.R.C. on Sep. 6, 2012, the entire contents of which are hereby incorporated by reference.

BACKGROUND

1. Technical Field

The invention relates to an electrical connector assembly, more particularly, to a Micro-USB connector assembly.

2. Related Art

Universal Serial Bus (USB) is a serial bus communication standard designed to provide a standard communication port between computer hardware and a host computer. Recently, the marketplace has developed consumer devices applying Universal Serial Bus to most consumer applications. A Universal Serial Bus ("USB") supports plug and play installation, and its development has increased due to the demand of higher data transmission and stability.

USB 2 has a maximum speed of 480 Mbps, which was considered adequate at the time of release but is now unsatisfactory due to the large size of multimedia data requiring high storage capacities of 64 GB or greater and the fact that cell phones and PDAs now have large capacity built-in storage, so a full transfer of data at 480 Mbps between devices can take a long time. The biggest difference between USB 2.0 and USB 3.0 is the speed at which it communicates with the computer's host controller, and the biggest advantage of USB 3.0 is its backward compatibility with USB 2.0. In comparison to USB 2.0, USB 3.0 has a maximum transfer speed of 4.8 Gbps, which is almost 10 times faster than USB 2.0. The standard claims a theoretical "maximum" transmission speed of up to 5 Gbit/s (625 MB/s). USB 3.0 reduces the time required for data transmission, reduces power consumption, and supports optical transmission. An optical USB cable in which an optical signal is transmitted using optical waveguides has recently been proposed. Fast speed is not the only difference; power usage and requirements for USB 3 devices are much "greener".

According to the trend of portable devices toward lightweight and thin product design, of all forms of USB connectors manufactured and in use, micro USB connectors are the primary option for new mobile electronics. Micro USB connectors are half the size of their mini USB counterparts, and have almost become the standard interface allowing consumers to not only charge their phones but also to send and receive data from the same port.

Portable devices use Micro-USB connectors for data transmission or charging. In conventional Micro-USB use, a portable device can only draw a small current after digital negotiation with the host or hub, resulting in a long charge time. It is needed to provide an efficient power transfer device.

In order to solve the problem(s), the present invention introduces a connector to increase power charging speed.

SUMMARY

The primary objective of the present invention is to provide a connector assembly which is able to increase USB device power charging speed.

In order to accomplish the aforementioned objective, the connector assembly of the preferred embodiment of the present invention has a plug including:

an insulative body having a base portion and a tongue portion extending from the base portion, a plurality of power contact grooves arranged on a top surface of the tongue portion and penetrating through the base portion and at least one first convex portion defined in a periphery of the tongue portion;

at least one first power contact including a first contact base portion and a plurality of first contact inserting portions, one side of the first contact base portion extending to the first contact inserting portions, the first contact inserting portions being inserted into the power contact groove of the insulative body, the width of the first contact base portion being larger than or equal to the summation of the widths of the first contact inserting portions;

at least one second power contact including a second contact base portion and a plurality of second contact inserting portions, one side of the second contact base portion extending to the second contact inserting portions, the second contact inserting portions being inserted into the power contact groove of the insulative body, the width of the second contact base portion being larger than or equal to the summation of the widths of the second contact inserting portions; and a metal shield enclosing the tongue portion of the insulative body to cover the tongue portion.

Another objective of the preferred embodiment of the present invention lies in the fact that the socket for connecting the plug is provided including:

a connector body provided with a plurality of contact grooves;

a plurality of connect terminals securely fixed in the contact grooves within the connector body for conducting electricity; and a connector metal shield enclosing the connector body and embossing on the surface of the connector metal shield to accommodate the first convex portion and the second convex portion for connecting to the metal shield.

It is to be noted from the objectives of the preferred embodiment of the present invention that the insulative body of the plug has first convex portions formed on two opposite sides of the tongue portion for a specified socket, which prevents the plug of the present invention from connection to an unwanted USB. The invention provides a fool-proofing device to prevent users from plugging the plug in sockets which are not designed for the structure of the present invention. In addition, the socket has a connector metal shield which embosses on the outer surface of the connector metal shield for accommodation of the first convex portion and the second convex portion to connect to the metal shield to provide the connection for the plug and socket.

DETAILED DESCRIPTION

The following description is merely exemplary in nature, and is in no way intended to limit the present teachings, applications, or uses. Those of skill in the art will recognize that the following description is merely illustrative of the principles of the invention, which may be applied in various ways to provide many different alternative embodiments.

Figure 1:
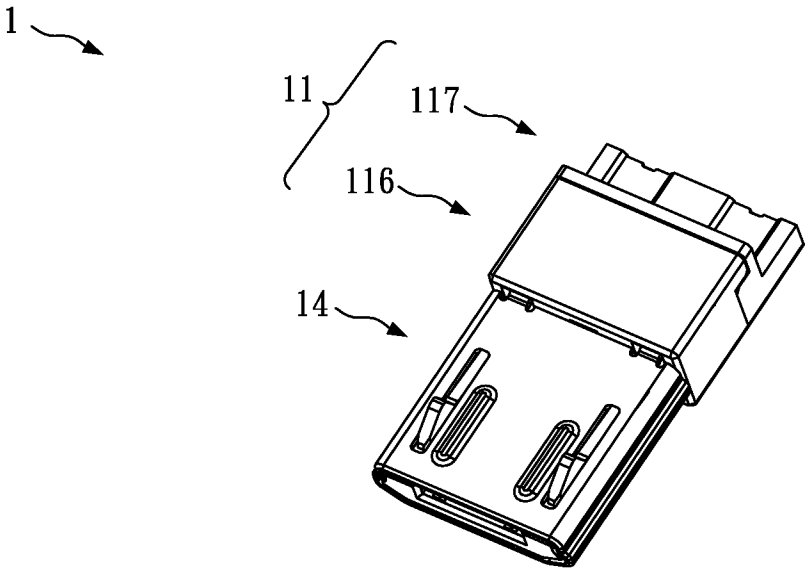
FIG. 1 is a perspective view of the plug of embodiment of the present invention.

FIG. 1 is an illustration of a perspective view of the preferred embodiment of the present invention. There is shown the connector assembly has a plug 1, which comprises a metal shield 14 and an insulative body 11 which has a first body portion 116 and a second body portion 117. In the preferred embodiment, the connector is utilized in Micro-USB device.

Figure 2:
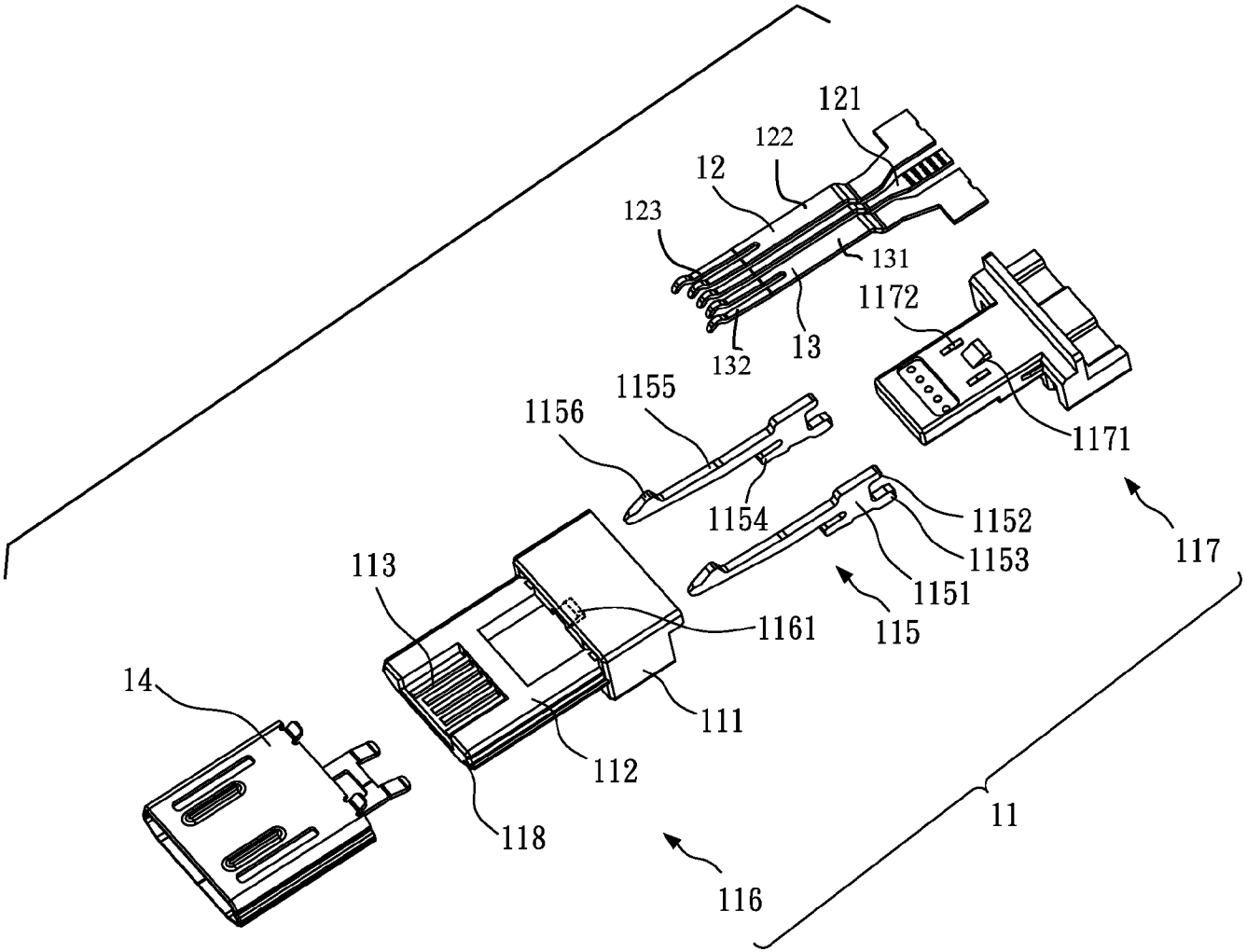
FIG. 2 is an exploded perspective view of the plug of embodiment of the present invention.
Figure 3:
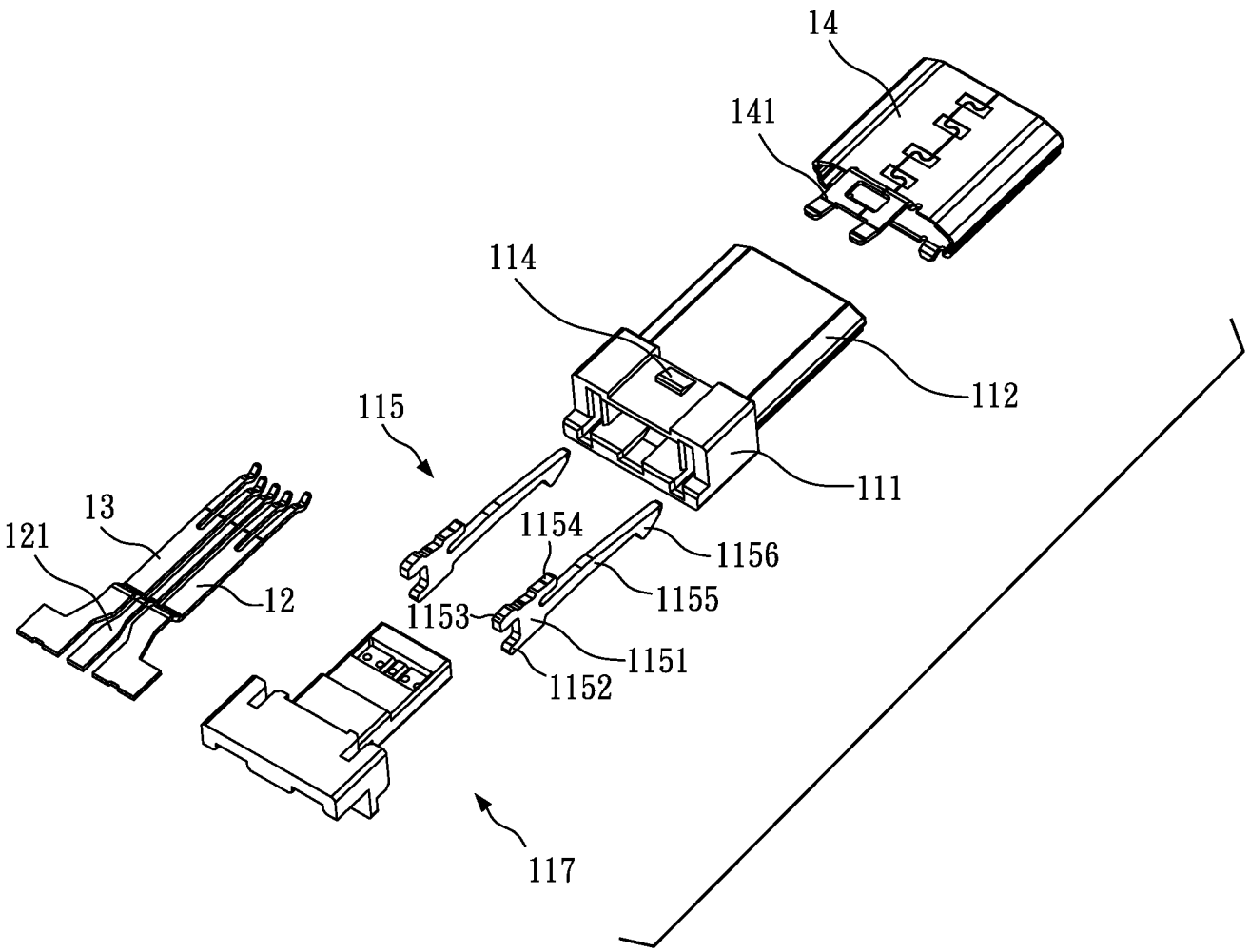
FIG. 3 is still an exploded perspective view of the plug of embodiment of the present invention.

FIGS. 2 and 3 are illustrations of the preferred embodiment of the present invention that the plug is illustrated in exploded perspective views. The insulative body 11 has a base portion 111 and a tongue portion 112 extending from the base portion 111. The tongue portion 112 includes a plurality of power contact grooves 113 arranged on a top surface of the tongue portion 112 and penetrated through the base portion 111 and at least one first convex portion 118 defined in a periphery of the tongue portion 112.

In addition, the insulative body 11 has one first body portion 116 secured another second body portion 117, such that a capacity space is formed inside the insulative body 11 to accommodate the base portion 111 and the tongue portion 112. The recess 114 is defined on an outer surface of the first body portion 116. The second body portion 117 comprises a bump 1171 and a rib 1172 on the top surface; the inner surface of the first body portion 116 has a groove 1161 to receive the bump 1171 so as to securely connected the first body portion 116 to the second body portion 117, the rib 1172 provides extra strength to connection of the first body portion 116 and the second body portion 117. The second body portion 117 is assembled with the first body portion 116 by the groove 1161 receiving the bump 1171, and the rib 1172 of the first body portion 116 also stiffens the second body portion 117 as both joined together.

Furthermore, the insulative body 11 has a plurality of latches 115 arranged in the capacity space of the first body portion 116 for fixedly connecting the plug 1 to the socket 2, the latches 115 comprise a fixing part 1151 that has an elastic arm 1155 extending through the first body portion 116 from the fixing part 1151 and forming a nail 1156 at a distal end of the elastic arm 1155. The fixing part 1151 includes a first fixing arm 1152 extending backward from top of the fixing part, a second fixing arm 1153 extending backward from bottom of the fixing part, and a third fixing arm 1154 extending forward from bottom of the fixing part 1151. Thus the retention of the latches 115 is strengthened by the fixing part 1151 in the insulative body 11.

The plug 1 has at least one first power contact 12 and at least one second power contact 13. The first power contact 12 includes a first contact base portion 122 and a plurality of first contact inserting portions 123, one side of the first contact base portion 122 is extending to the first contact inserting portions 123, the first contact inserting portions 123 is inserted into the power contact groove 113 of the insulative body 11, the width of the first contact base portion 122 is larger than or equal to the summation of the widths of the first contact inserting portions 123. The second power contact 13 includes a second contact base portion 131 and a plurality of second contact inserting portions 132, one side of the second contact base portion 131 is extending to the second contact inserting portions 132, the second contact inserting portions 132 is inserted into the power contact groove 113 of the insulative body 11, the width of the second contact base portion 131 is larger than or equal to the summation of the widths of the second contact inserting portions 132. In this embodiment, a contact 121 is further disposed between the first power contact 12 and the second power contact. In the prefer embodiment, there are electric contacts embedded on both of the first power contact 12 and the second power contact 13 in the second body portion 117 of the insulative body 11 for connection to a power source in a socket of host device.

A metal shield 14 encloses the tongue portion 112 of the insulative body 11 and has a protruding ring 141 formed on an edge of upper surface of the metal shield 14 to fix into the recess to fix into the recess 114 firmly.

Figure 4:
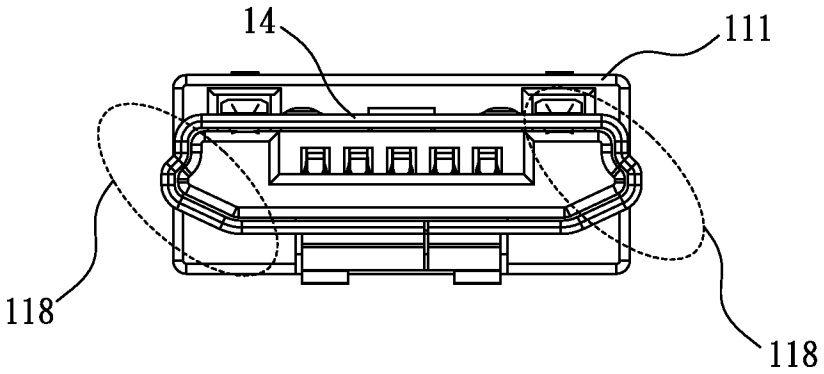
FIG. 4 is a front view of the plug of embodiment of the present invention.
Figure 5:
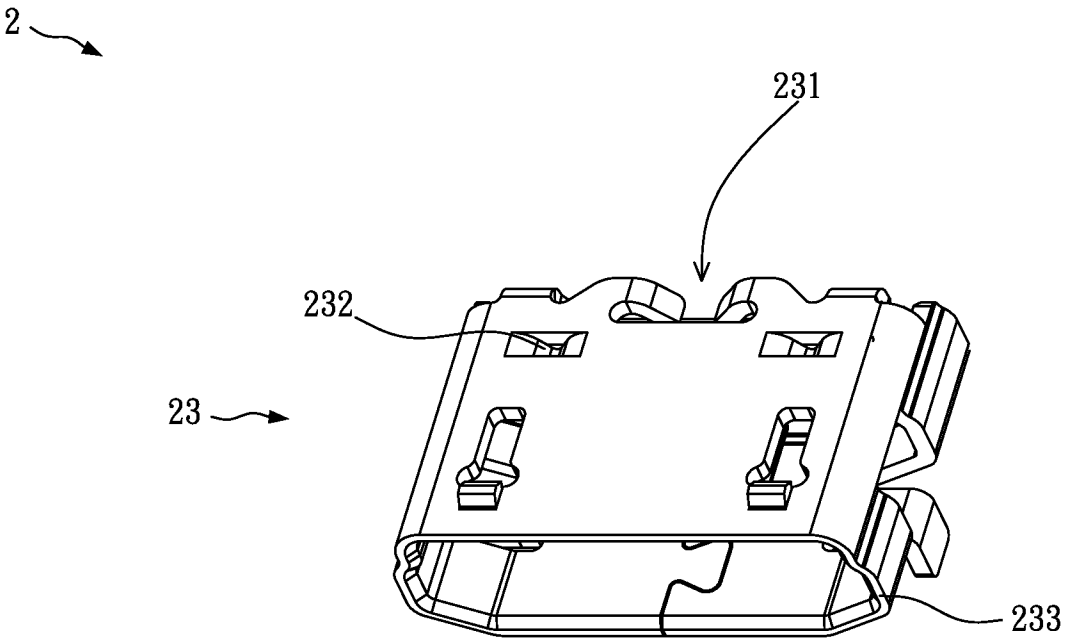
FIG. 5 is a perspective view of the socket of embodiment of the present invention.
Figure 6:
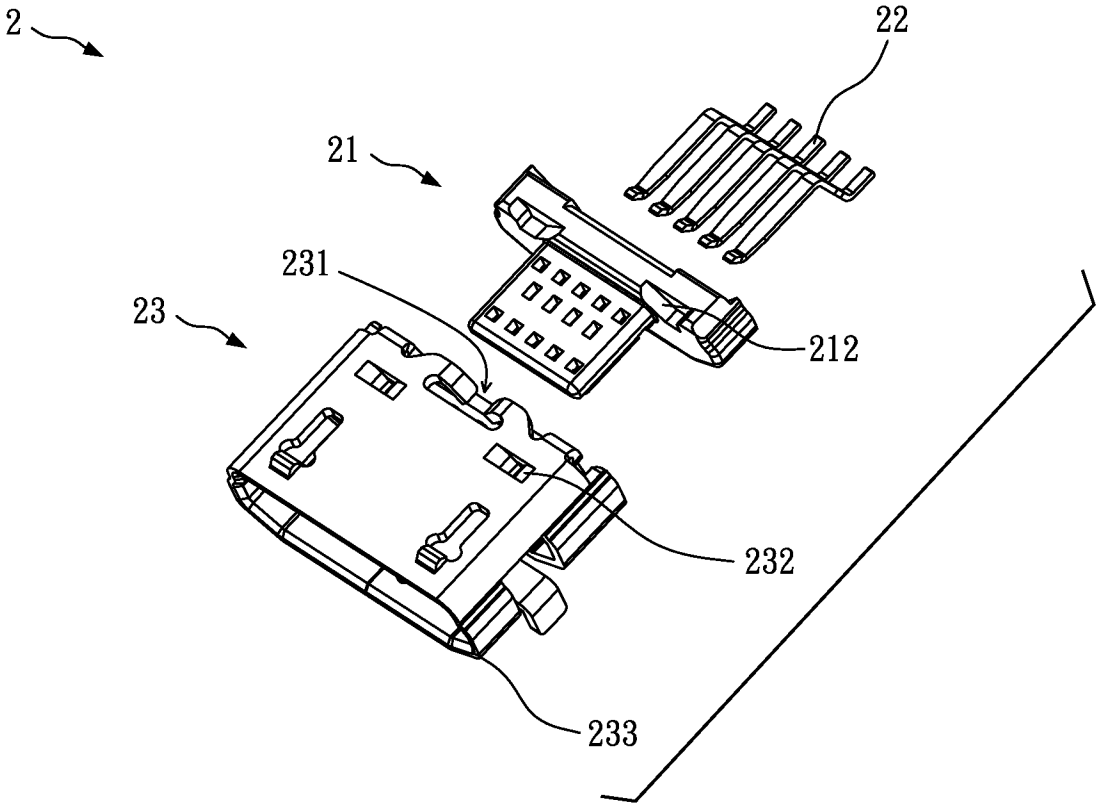
FIG. 6 is an exploded perspective of the socket of embodiment of the present invention.
Figure 7:
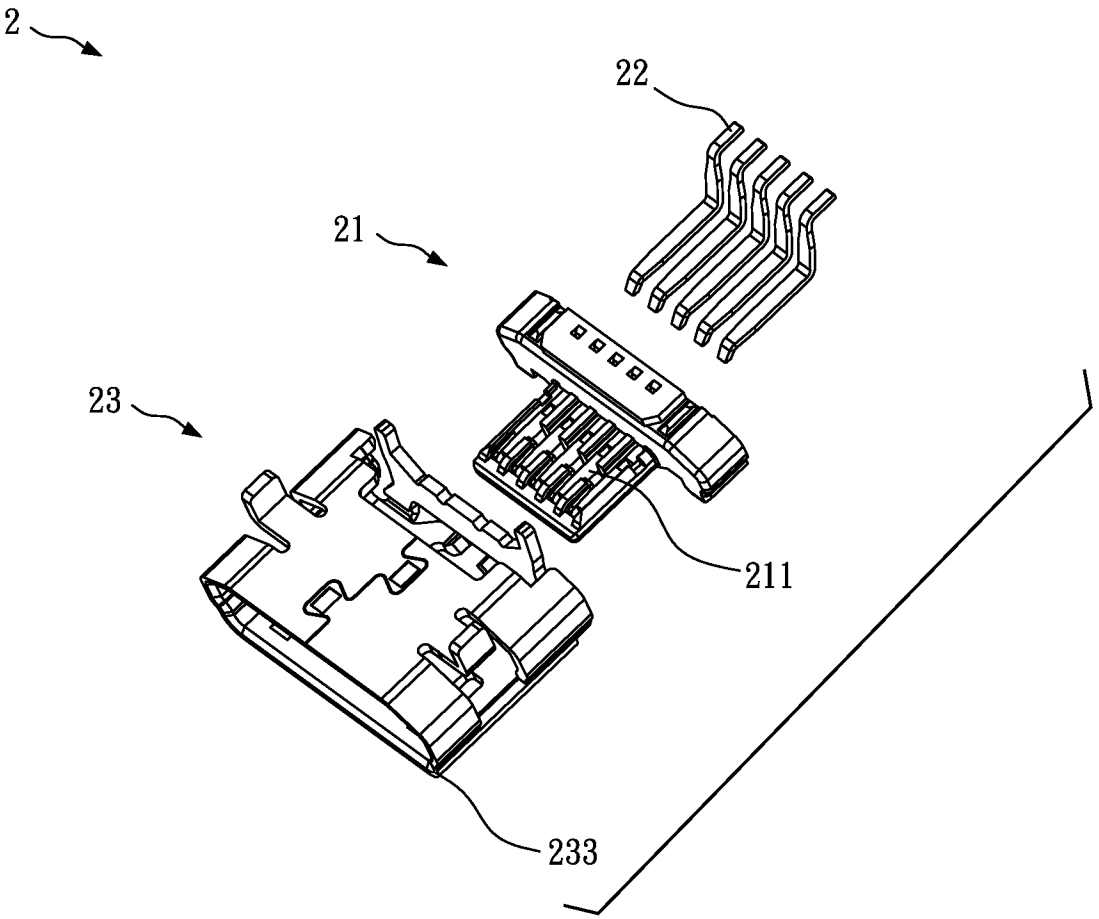
FIG. 7 is an exploded perspective of the socket of embodiment of the present invention.
Figure 8:
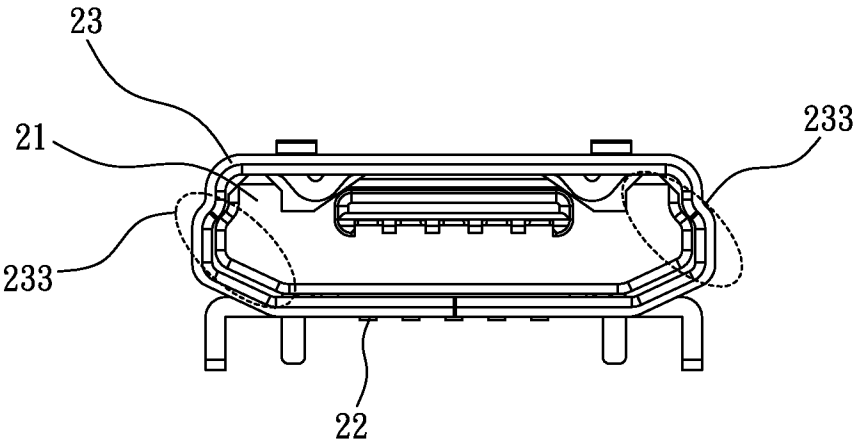
FIG. 8 is a front view of the socket of embodiment of the present invention.
Figure 9:
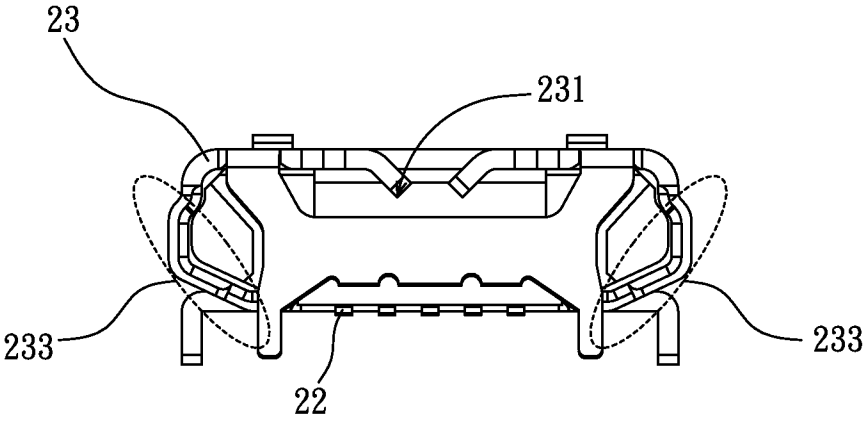
FIG. 9 is a rear view of the socket of embodiment of the present invention.

FIG. 4 is an illustration of the preferred embodiment of the present invention that the plug is illustrated in front view. In FIG. 4, two first convex portions 118 are formed on two lateral sides of the tongue portion 112 for slidably plugging the plug 1 into the socket 2. The outer surface of the first body portion 116 has a recess 114 and the metal shield 14 is provided with a protruding ring 141 formed on an edge of upper surface to fix into the recess 114. Then the metal shield 14 is secured to the first body portion 116.

In FIGS. 5, 6, 7, 8 and 9, the socket 2 for connecting the plug 1 constructed in accordance with the preferred embodiment of the present invention is composed of a connector body 21, a plurality of connect terminals 22 and a connector metal shield 23.

The connector body 21 is provided with a plurality of contact grooves 211. A plurality of connect terminals 22 securely fix in the contact grooves 211 within the connector body 21 to conduct electricity. A connector metal shield 23 encloses the connector body 21 and embosses on the surface of the connector metal shield 23 for accommodation of the first convex portion 118 and the second convex portion 233 to connect to the metal shield 14. Please refer to FIG. 9, in which embodiment the connector metal shield 23 comprises at least one rivet 231 on the surface of the connector metal shield 23 for assembling the connector body 21 inside the connector metal shield 23, avoiding the connector body 21 slipping away from the connector metal shield 23 as the plug 1 is connecting to the socket 2. The connector metal shield 23 has at least one concave part 232 defined at an outer face of the connector metal shield 23, and the connector body 21 has at least one concave groove 212 defined at an outer face of the connector body 21 to receive the concave part 232 of the connector metal shield 23. In this way, the stability of binding the connector body 21 to the connector metal shield 23 will be guaranteed. Also, the connector metal shield 23 could be bent downward as a pin, which restricts and fixes the connector body 21 inside the connector metal shield 23.

With references to all figures, as mentioned previously, the connection functional description is described here. The plug 1 has at least one first power contact 12 and at least one second power contact 13 being disposed at the power contact groove 113 of the insulative body 11. The first power contact 12 provides a short circuit to pin1 and pin2 and the second power contact 13 provides a short circuit to pin4 and pin5 of the Micro-USB. The first power contact 12 and the second power contact 13 will pass the electric current. Accordingly, the width of the first power contact 12 and the second power contact 13 are increased. In experiment, the electrical device can be charged with electric current of 2.5 A rapidly with the embodiment. In addition, the pin3 in the Micro-USB is disconnected and will not be active electrically.

Moreover, the insulative body 11 of plug 1 has a first convex portion 118 extending from the outer surface of the tongue portion 112, so the plug 1 is unable to plug the Micro-USB in the prior art, the invention provides a fool-proofing device to prevent users from plugging the plug 1 in the conventional sockets which are not designed from the structure of the present invention.

In addition, the invention includes the socket 2 for connecting the plug 1, in which a connector metal shield 23 encloses the connector body 21 and embosses on the surface for accommodation of the first convex portion 118 and the second convex portion 233. Please refer to FIG. 8, in which two second convex portions 233 are formed on both side of connector metal shield 23 corresponding to the first convex portion 118. Accordingly, the structure of the socket 2 is able to connect the plug 1, and the nail 1156 of the elastic arm 1155 in the latches 115 connects the connector metal shield 23 in the socket 2. Furthermore, the socket 2 is able to connect any plug compatible to Micro-USB in prior art.

With reference to all Figures, the invention has advantages over background art. The socket 2 is able to provide big electric current to charge USB pluggable devices, which utilize the invention. Product Competitiveness is promoted because of the socket 2 is compatible with conventional plug for most of Micro-USB.

It is to be noted that although the preferred embodiment of the present invention has been described, other modifications, alterations or minor change to the structure should still be within the scope defined in the claims. As those skilled in the art will readily observe that numerous modifications and alterations of the device and method may be made while retaining the teachings of the invention.

What is claimed is:

1. A connector assembly having a plug and a socket, wherein the plug comprises:

an insulative body having a base portion and a tongue portion extending from the base portion, a plurality of power contact grooves arranged on a top surface of the tongue portion and penetrated through the base portion;

at least one first power contact comprising a first contact base portion and a plurality of first contact inserting portions, one side of the first contact base portion extending to the first contact inserting portions, the first contact inserting portions being inserted into the power contact groove of the insulative body, the width of the first contact base portion being larger than or equal to the summation of the widths of the first contact inserting portions;

at least one second power contact comprising a second contact base portion and a plurality of second contact inserting portions, one side of the second contact base portion extending to the second contact inserting portions, the second contact inserting portions being inserted into the power contact groove of the insulative body, the width of the second contact base portion being larger than or equal to the summation of the widths of the second contact inserting portions; and a metal shield enclosing the tongue portion of the insulative body to cover the tongue portion.

2. The connector assembly as claimed in claim 1, wherein the insulative body comprises a first body portion and a second body portion securely connected to the first body portion to form a capacity space to accommodate the base portion and the tongue portion.

3. The connector assembly as claimed in claim 2, wherein the second body portion comprises a bump and at least a rib on an outer surface of the second body portion, a groove is formed on an inner surface of the first body portion to receive the bump so as to securely connected the first body portion to the second body portion, the rib provides extra strength to connection of the first body portion and the second body portion.

4. The connector assembly as claimed in claim 1, wherein the insulative body comprises a recess on an outer surface of a first body portion, the metal shield has a protruding ring formed on an edge of upper surface of the metal shield to be fixed in the recess.

5. The connector assembly as claimed in claim 1, wherein at least one first convex portion is defined in a periphery of the tongue portion.

6. The connector assembly as claimed in claim 1, wherein the insulative body further comprises a plurality of latches arranged inside the first body portion for fixedly connecting the second body portion to the base portion.

7. The connector assembly as claimed in claim 6, wherein the latch comprises a fixing part and an elastic arm extending through the first body portion from the fixing part and forming a nail at a distal end of the elastic arm, the fixing part includes a first fixing arm extending backward from top of the fixing part, a second fixing arm extending backward from bottom of the fixing part, and a third fixing arm extending forward from bottom of the fixing part, the fixing part strengthens the retention of the latch in the insulative body.

8. The connector assembly as claimed in claim 1, wherein the socket comprising:

a connector body provided with a plurality of contact grooves;

a plurality of connect terminals securely fixed in the contact grooves within the connector body for conducting electricity; and a connector metal shield enclosing the connector body and embossing on the surface of the connector metal shield to accommodate the first convex portion and the second convex portion for connection to the metal shield.

9. The connector assembly as claimed in claim 8, wherein the metal shield comprises at least one rivet on the surface of the connector metal shield to assemble the connector body inside the connector metal shield.

10. The connector assembly as claimed in claim 8, wherein the connector metal shield has at least one concave part defined at an outer face of the connector metal shield and the connector body has at least one concave groove defined at an outer face of the connector body to receive the concave part of the connector metal shield.

* * * * *